United States Patent [19]

Butts

[11] 3,934,645

[45] Jan. 27, 1976

[54] FINNED TUBE PROTECTOR

[75] Inventor: Oscar Wesley Butts, Tulsa, Okla.

[73] Assignee: Yuba Heat Transfer Corporation

[22] Filed: Feb. 1, 1974

[21] Appl. No.: 438,948

[52] U.S. Cl. ..... 165/67; 165/134; 165/162; 165/172

[51] Int. Cl.[2] ..... B22D 23/00

[58] Field of Search ..... 165/134, 69, 67, 172, 162; 292/307; 85/5 R

[56] References Cited

UNITED STATES PATENTS

| | | | |
|---|---|---|---|
| 2,096,319 | 10/1937 | Churchill | 85/5 R X |
| 2,608,388 | 8/1952 | Miller | 165/172 X |
| 2,695,723 | 11/1954 | Waterman | 220/4 E |
| 2,899,097 | 8/1959 | Haskins | 220/4 E |
| 3,273,638 | 9/1966 | Darling | 165/134 |
| 3,311,396 | 3/1967 | Hotchkiss | 292/307 |
| 3,420,296 | 1/1969 | Urner | 165/134 |
| 3,664,538 | 5/1972 | Fioretti | 220/4 E |

*Primary Examiner*—Albert W. Davis, Jr.
*Assistant Examiner*—James D. Liles
*Attorney, Agent, or Firm*—Head and Johnson

[57] ABSTRACT

A support device for finned tubes having a pair of half sections adapted to be quickly and securely snapped into position around the outer periphery of the fins for supporting the finned tubes in a manner precluding damage to the fins, and particularly designed and constructed for remaining in the preselected position with relation to the finned tube, each half section comprising mutually parallel spaced sidewall means having a substantially semi-circular recess provided on one edge thereof for engaging the outer periphery of the tube, outer band means spanning the distance between the sidewall means and disposed at the edge thereof opposite the recess means, flap means interposed between the sidewall means and conterminous with the band means, locking means provided on said flap means and interengagable for securely snap locking the half sections around the outer periphery of the finned tube, and the outer configuration of the assembled half sections being substantially rectangular.

3 Claims, 2 Drawing Figures

FINNED TUBE PROTECTOR

BACKGROUND OF THE INVENTION

1. Field of the Invention

This invention relates to improvements in finned tubes and more particularly, but not by way of limitation, to a protector device particularly designed and constructed for quick assembly on the finned tube for supporting the tube and protecting the fins.

2. Description of the Prior Art

Heat exchangers, and the like, usually utilize finned tubes for heat transfer between fluids, or other substances. These finned tubes normally comprise a central tube having a plurality of radially outwardly extending longitudinally spaced fins on the outer periphery thereof for facilitating or accelerating the rate of heat transfer. The fins may be either a plurality of spaced individual annular discs secured to the outer periphery of the tube, or may be a continuous spiral or helical member extending around the tube. The finned tubes are usually supported horizontally in the heat exchanger with the opposite ends thereof connected to headers or other parts of the apparatus. These tubes are normally relatively long and tend to sag between the headers unless intermediate support means is provided therefor. The tubes and particularly the fins are usually constructed from a relatively thin gauge material and thus do not have sufficient strength or rigidity to withstand the forces of a support member secured directly thereto. In addition, the outer periphery of the fins may be damaged by contact with the fins of an adjacent finned tube it there is sufficient sagging wherein one tube may rest against a portion of a second tube.

In order to overcome the above disadvantages, support devices have been developed for supporting the finned tubes from one another in a manner which protects the fins, such as that shown in the Raymond A. Darling U.S. Pat. No. 3,273,638, issued Sept. 20, 1966, and entitled "Finned Tube Protector"; and the Jimmie L. Urner U.S. Pat. No. 3,420,296, issued Jan. 7, 1969, and entitled "Finned Tube Protector Band". Many of these devices have certain disadvantages, however, in that it is frequently difficult and time consuming to install the devices on the finned tubes in a secure manner. In addition, the protectors may move or roll longitudinally along the tubes during use of the heat exchanger, or the like, whereby the associated support members are no longer in an aligned position for engaging one another during supporting of the tubes. In this manner the fins of one tube may be damaged by contact with the fins of an adjacent tube as hereinbefore set forth.

SUMMARY OF THE INVENTION

The present invention contemplates a finned tube protector which has been particularly constructed for overcoming the above disadvantages. The novel protector comprises two substantially identical half sections having sidewalls provided with an arcuate recess for engagement with the outer periphery of the tube element, and an outer band or wall spaced from the outer periphery of the tube element a sufficient distance to provide clearance for the outer periphery of the fins. Each half section is provided with locking means readily engagable upon positioning of the half sections around the outer periphery of the finned tube for quickly and easily securely locking the half sections in position around the tube. In addition, the outer configuration of the assembled half sections is substantially square or rectangular whereby each protector device is not only securely locked around the outer periphery of the finned tube, but also is retained in the preselected position thereon. The novel finned tube protector is simple and efficient in operation and economical and durable in construction.

DESCRIPTION OF THE PREFERRED EMBODIMENT

Figure 1:
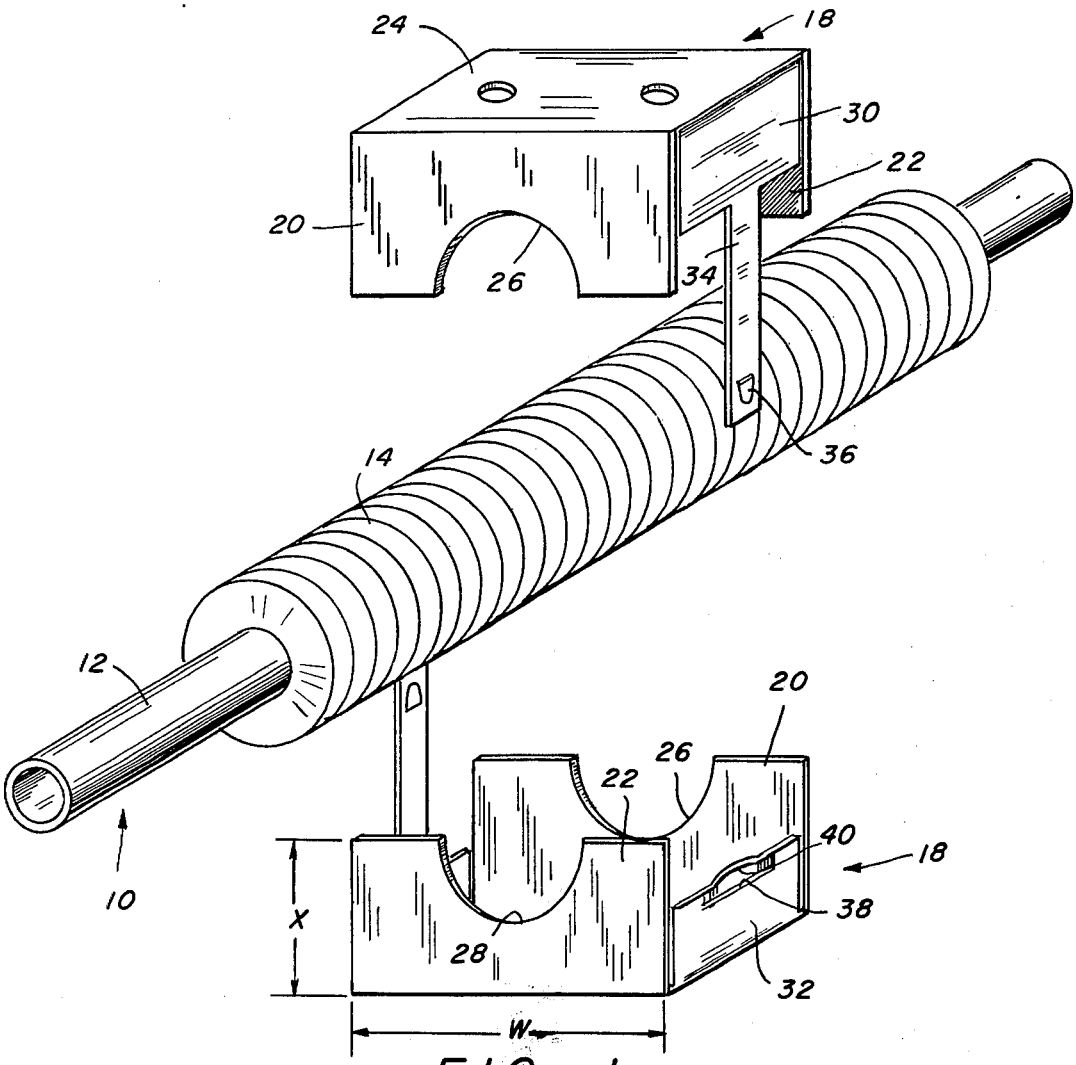
FIG. 1 is an isometric view of a finned tube protector embodying the invention in position for being disposed around a finned tube.

Referring now to the drawings in detail, reference character 10 generally indicates a finned tube comprising a central tube member 12 having a spiral or helical radially outwardly extending coil 14 secured to the outer periphery thereof and extending substantially throughout the length thereof to provide a plurality of heat dispersing or heat dispensing fins, as is well known. A plurality of finned tube protectors or supports 16 may be longitudinally spaced along the finned tube 10 in a manner and for a purpose as will be hereinafter set forth.

Each finned tube protector or support 16 comprises a pair of substantially identical half sections 18, and since the two half sections 18 are of a substantially identical configuration, only one will be set forth in detail herein. The half section 18 comprises substantially mutually parallel sidewalls 20 and 22 spaced apart by an outer wall or band 24, which is preferably integral with the walls 20 and 22, but not limited thereto. Each sidewall 20 and 22 is provided with a substantially semi-circular recess 26 and 28, respectively, on the outer edge thereof, preferably of a diameter substantially equal to the outer diameter of the tube 12. The overall width W of the sidewalls 20 and 22 is preferably slightly greater than the outer diameter of the fins 14, and the depth X of the sidewalls 20 and 22 is preferably slightly greater than the radius of the fins 14 for a purpose as will be hereinafter set forth.

The band or wall 24 extends beyond the outer limits of the sidewalls 20 and 22 to provide a pair of oppositely disposed flaps 30 and 32, which are bent or folded substantially perpendicular to the plane of the band 24 for disposition between the spaced side edges of the sidewalls 20 and 22. Of course, it will be apparent that the flaps 30 and 32 may be integral with the band 24 and/or sidewalls 20 and 22, or may be otherwise secured thereto in any well known manner, and there is no intention of limiting the invention to the exact manner of construction depicted herein. One of the flap members, such as the flap member 30, is provided with an outwardly extending coplanar fastening arm 34 which may be integral therewith or secured thereto in any well known manner. The arm 34 is provided with an indentation 36 in the proximity of the outer end thereof which forms a protrusion element (not shown) on the inwardly directed surface of the arm 36. The flap 32 is provided with a slit 38 in the proximity of the outer edge thereof, and the portion 40 of the flap 32 interposed between the slit 38 and the outer edge of the flap 32 is arcuately deformed providing an inwardly directed cavity in the proximity of the slit 38 for a purpose as will be hereinafter set forth.

As will be apparent from an inspection of FIG. 1, the outer configuration of the sidewalls 20 and 22 is substantially rectangular, with the band 24 and flaps 30 and 32 cooperating therewith to provide a substantially open ended box-like configuration for the half section 18.

In order to install the fin protector 16 on the finned tube 10, a pair of half sections 18 may be manually positioned on opposite sides of the tube 10 as shown in FIG. 1. One of the sections 18 at a time or both of the sections 18 may be moved simultaneously in a direction toward the tube 10 until the arcuate or semi-circular recesses 26 and 28 are disposed adjacent the outer periphery of the tube 12, and the sidewalls 20 and 22 are positioned between selected pairs of fins 14 for proper spacing of the device 16 on the tube 10. When the half sections 18 are moved in directions toward each other in this manner, the fastener arms 34 of each section 18 will be moved into engagement with the flaps 32 of the other section 18, and when the sections 18 are positioned against the outer periphery of the tube 12, the outer ends of the arms 34 will move through the slits 38 of the flaps 32 until the indentation members 36 pass through the slits 38. Once the indentation members 36 have passed through the slite 38, the projection portion of the arms 34 will cooperate with the arcuate recess portions 40 for precluding separation of the two half sections 18, thus securely locking the two half sections around the tube 10 as shown in FIG. 2.

Since the dimension X is greater than the radius of the fins 14 and the width W is greater than the diameter of the fins 14, the protector member 16 will engage only the outer periphery of the tube 12 and will substantially encase a plurality of adjacent fins 14 for protection thereof.

Substantially any desired number of the protector members 16 may thus be secured around the finned tube 10, and spaced therealong as required for supporting the tube or tube 10. It is preferable that a protector member 16 be secured around each adjacent finned tube 10 at substantially the same spacing whereby the first finned tube of a series may be supported by the protector members from a suitable supporting surface (not shown), and each succeeding finned tube may be supported by the engagement of the respective protectors 16 disposed on the protectors 16 of the preceding tube 10. The substantially rectangular configuration of the half sections 18 provide a substantially square or rectangular configuration for the assembled protector 16, thus substantially precluding any accidental rolling or other movement of the protector member 16 along the respective tubes 10. Thus, the protector members 16 may not only be quickly and easily disposed on the finned tubes 10 and securely locked thereon, but also are efficiently retained in the preselected position on the tubes 10.

Figure 2:
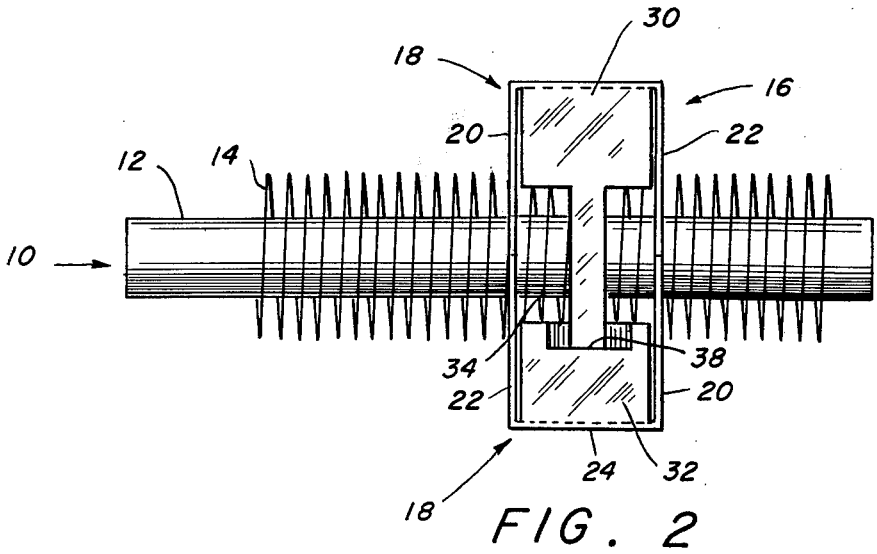
FIG. 2 is a side elevational view of a tube protector embodying the invention as secured around a finned tube.

Whereas the illustration of FIG. 2 depicts the outer periphery of the fins 14 as being substantially smaller than the inner dimensions of the protector member 16, it will be apparent that the spacing between adjacent finned tubes in many heat exchangers, or the like (not shown) is frequently not sufficiently great to permit such an exaggerated difference between the two dimensions. However, it is only necessary that the interior dimensions of the protector 16 be slightly larger than the outer dimensions of the fins 14.

From the foregoing it will be apparent that the present invention provides a novel finned tube protector comprising a pair of substantially identical half sections of a substantially rectangular outer configuration which may be quickly and easily placed around the finned tube during installation of the protector members thereon. Each half section is provided with a fastening arm and complementary receiving element whereby the two half sections may be automatically locked together upon the assembly of the half sections around the finned tube. The substantially square or rectangular outer configuration of the assembled half sections substantially precludes accidental rolling of the protector members along the outer periphery of the finned tube, thus assuring that the protector members will remain in the preselected position thereon.

Whereas the present invention has been described in particular relation to the drawings attached hereto, it should be understood that other and further modifications, apart from those shown or suggested herein, may be made within the spirit and scope of this invention.

What is claimed is:

1. In combination with a finned tube including a central tube having a plurality of radially extending fins on the outer periphery thereof, a protector device comprising a pair of substantially identical independent half sections adapted for disposition on the central tube for encasing a plurality of adjacent fins, each of said half sections comprising mutually parallel spaced sidewall means of a substantially rectangular configuration and having a substantially semi-circular recess provided on one edge thereof for engaging the outer periphery of the central tube, outer band means spanning the distance between the sidewall means and disposed at the edge thereof opposite the recess means, first flap means conterminous with one end of the band means and extending substantially perpendicularly therefrom between the sidewall means, second flap means conterminous with the opposite end of the band means and extending substantially perpendicularly therefrom between the sidewall means, an elongated arm member extending outwardly from said first flap means and of a width less than the width of said first flap means, said arm member being engagable with the second flap means of the other half section, and complementary locking means provided on said arm member and second flap means and slidably interengagable for securely snap locking the half sections around the outer periphery of the finned tube as the half sections are moved in directions toward one another with the outer ends of said flap means being spaced apart for providing openings at each end of the protector device installed on the finned tube, said locking means comprising recessed slit means provided on said second flap member for receiving the end of said elongated arm therethrough in a manner substantially precluding accidental seperation of the assembled half-sections.

2. The combination as set forth in claim 1 wherein the diameter of the semi-circular recess means is substantially equal to the outer diameter of the central tube.

3. The combination as set forth in claim 1 wherein the width of the sidewalls of each half section is slightly greater than the diameter of the fins, and the depth of the sidewalls of each half section is slightly greater than the radius of the fins.

* * * * *